US006307582B1

(12) United States Patent
Kawato et al.

(10) Patent No.: US 6,307,582 B1
(45) Date of Patent: Oct. 23, 2001

(54) INK RIBBON CASSETTE WHICH CAN BE USED IN LINE TYPE THERMAL TRANSFER PRINTER

(75) Inventors: Junichi Kawato; Yuji Chiba, both of Iwate-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/692,002

(22) Filed: Oct. 19, 2000

(30) Foreign Application Priority Data

| | | |
|---|---|---|
| Oct. 29, 1999 | (JP) | 11-309399 |
| Nov. 29, 1999 | (JP) | 11-337397 |
| Nov. 29, 1999 | (JP) | 11-337398 |
| Dec. 9, 1999 | (JP) | 11-350498 |
| Feb. 4, 2000 | (JP) | 12-032762 |

(51) Int. Cl.[7] ..... B41J 32/00
(52) U.S. Cl. ..... 347/214
(58) Field of Search ..... 347/214, 216; 400/207, 208, 208.1, 247, 248

(56) References Cited

U.S. PATENT DOCUMENTS 6,008,832 12/1999 Sato .

*Primary Examiner*—Huan Tran
(74) *Attorney, Agent, or Firm*—Brinks Hofer Gilson & Lione

(57) ABSTRACT

An ink ribbon cassette includes a cassette main body portion rotatably holding a supply core and a take-up core around which the end portions of an ink ribbon are wound and a ribbon guide portion extending to one side from the cassette main body portion and having on one side a ribbon slide contact surface, a ribbon turn-up portion formed at the forward end of the ribbon guide portion being formed by a rotatable roller member, whereby the frictional resistance of the ink ribbon turned up at the ribbon turn-up portion is reduced. Further, the main body portion includes a holder member having the ribbon guide portion and holding the supply core and the take-up core and a case member capable of holding the holder member by holding the supply core and the take-up core in such a way as to cover them from outside, whereby it is possible to provide an ink ribbon cassette which can be easily assembled.

15 Claims, 9 Drawing Sheets

INK RIBBON CASSETTE WHICH CAN BE USED IN LINE TYPE THERMAL TRANSFER PRINTER

BACKGROUND OF THE INVENTION

1. Field of the Invention

The present invention relates to an ink ribbon cassette and, in particular, to an ink ribbon cassette which can be suitably used in a line type thermal transfer printer.

2. Description of the Related Art

A conventional ink ribbon cassette 20 used in a line type thermal transfer printer will be described with reference to FIGS. 10 and 11. On the right-hand side as seen in the drawing, there is formed a main body portion 24 which rotatably supports a supply core 22 around which an ink ribbon 21 is wound and a take-up core 23.

Further, as shown in FIG. 11, in the vicinity of the supply core 22 of the main body portion 24, there is formed a ribbon outlet 24*a* through which the ink ribbon 21 wound around the supply core 22 can be drawn out in the direction of the arrow B.

Further, a ribbon guide portion 25 extends to the left from the main body portion 24. This ribbon guide portion 25 has a ribbon turn-up portion 25*a* in the lower portion of the forward end portion thereof and, further, there are provided a flat first ribbon slide contact surface 25*b* extending upwardly substantially at right angles from the ribbon turn-up portion 25*a,* an inclined second ribbon slide contact surface 25*c* connected to the first ribbon slide contact surface 25*b,* and a horizontal third ribbon slide contact surface 25*d* connected to the second ribbon slide contact surface 25*c,* the ink ribbon 21 being capable of being drawn around the outer peripheral surfaces of the first, second and third slide contact surfaces 25*b,* 25*c* and 25*d.*

The ink ribbon 21, drawn out from the ribbon outlet 24*a* in the direction of the arrow B, is turned up upwardly substantially at right angles (in the direction of the arrow C) at the ribbon turn-up portion 25*a,* and can be drawn around along the first ribbon slide contact surface 25*b.*

Further, between the ink ribbon 21 drawn out from the ribbon outlet 24*a* in the direction of the arrow B and the upper ribbon guide portion 25, there is formed a head insertion portion 26 into which a line thermal head (not shown) on the printer side can be inserted.

In the ink ribbon cassette 20 described above, by rotating the take-up core 23 in the direction of the arrow A, the ink ribbon 21 wound around the supply core 22 is drawn out from the ribbon outlet 24*a* in the direction of the arrow B.

And, the ink ribbon 21 is turned up by substantially 90 degrees at the ribbon turn-up portion 25*a* to the first ribbon slide contact surface 25*b,* and, from the first ribbon slide contact surface 25*b,* drawn around the outer peripheral surfaces of the second and third slide contact surfaces 25*c* and 25*d* in the direction of the arrow D to be taken up by the take-up core 23.

The operation of printing by a thermal transfer printer (not shown) by using this conventional ink ribbon cassette 20 will be described. When the ink ribbon cassette 20 is attached to a cassette attachment portion (not shown) on the printer side, a line thermal head (not shown) having a plurality of heat generating elements is positioned in the head insertion portion 26, and the rotation shaft of the take-up core 23 is engaged with a rotation shaft which is rotated by a motor (not shown) serving as a drive source.

Further, recording paper (not shown) is fed and positioned below the ink ribbon 21 drawn to a position below the head insertion portion 26.

Next, a platen roller (not shown) positioned below the line thermal head positioned in the head insertion portion 26 and the line thermal head are moved relative to each other to bring the platen roller and the line thermal head into press contact with each other through the intermediation of the ink ribbon 21 and the recording paper.

And, the recording paper is fed while selectively causing the heat generating elements of the line thermal head to generate heat, the take-up core 23 is rotated in the direction of the arrow A through the rotation of the motor serving as the drive source to take up the ink ribbon 21 on the take-up core 23, whereby ink of the ink ribbon 21 is transferred to the recording paper, making it possible to print a desired image on the recording paper.

In the conventional ink ribbon cassette 20 described above, the ink ribbon 21 positioned in the main body portion 24 and the ribbon guide portion 25 is exposed, so that when the operator handles the ink ribbon cassette 20, he or she may touch the ink ribbon 21 to cause it to wrinkle. When the ink ribbon 21 wrinkles, the printing quality deteriorates.

Further, at the ribbon turn-up portion 25*a,* the ink ribbon 21 is drawn to the first slide contact portion 25*b,* which is perpendicular to the ribbon turn-up portion 25*a,* so that the frictional resistance is maximum at the ribbon turn-up portion 25*a* and the first slide contact portion 25*b,* and the ribbon guide portion 25 is deflected to suffer deformation when the ribbon is taken up on the take-up core 23, with the result that biasing or the like occurs when running the ribbon.

Further, since the ink ribbon 21 offers large frictional resistance at the ribbon turn-up portion 25*a* and the first ribbon slide contact surface 25*b,* the take-up torque when taking up the ink ribbon 21 on the take-up core 23 is large, and a large capacity is needed for the motor serving as the drive source, resulting in an increase in the power consumption of the printer.

SUMMARY OF THE INVENTION

The present invention has been made in view of the above problems. It is an object of the present invention to provide an ink ribbon cassette comprising a main body portion accommodating an ink ribbon, a supply core and a take-up core which are accommodated in the main body portion so as to be adjacent to each other and around which the end portions of the ink ribbon are wound, a ribbon guide portion extending to one side from the main body portion and having on one side a ribbon slide contact surface, and a ribbon turn-up portion formed at the forward end of the ribbon guide portion, wherein the ink ribbon is temporarily drawn out to the exterior from a ribbon outlet formed in the main body portion, and turned up at the ribbon turn-up portion before it runs on the ribbon slide contact surface of the ribbon guide portion until it is drawn into the interior of the main body portion through an ink ribbon inlet formed in the main body portion and taken up on the take-up core, whereby there is no fear of the ink ribbon being inadvertently touched while the ribbon cassette is being handled, and wrinkles or the like are not easily generated in the ink ribbon during handling.

Another object of the present invention is to provide an ink ribbon cassette wherein the ribbon turn-up portion is formed by a rotatable roller member, whereby the frictional resistance generated in the ink ribbon turned up at the ribbon turn-up portion.

Still another object of the present invention is to provide an ink ribbon cassette wherein the roller member has a hand-drum-like configuration whose size is smaller near its central portion than its end portions, whereby an outward tension in the width direction is applied to the ink ribbon turned up at the roller member, whereby wrinkles or the like are prevented from being generated in the ink ribbon.

A further object of the present invention is to provide an ink ribbon cassette wherein the turn-up angle of the ink ribbon turned up at the ribbon turn-up portion is set at 10 to 80 degrees and the frictional resistance at the ribbon turn-up portion when taking up the ink ribbon is reduced through distribution, whereby the ribbon guide portion is not deflected when taking up the ink ribbon, thereby preventing troubles such as biasing of the ink ribbon.

A still further object of the present invention is to provide an ink ribbon cassette wherein the turn-up angle of the ink ribbon is 60 degrees, whereby the frictional resistance of the ink ribbon turned up at the ribbon turn-up portion is further reduced.

A still further object of the present invention is to provide an ink ribbon cassette wherein a rotatable guide roller is arranged at the portion of the ribbon outlet which comes into contact with the ink ribbon, whereby it is possible to reduce the take-up torque of the take-up core for drawing out the ink ribbon wound around the supply roller at the time of printing, with the result that it is possible to reduce the capacitance of the motor for rotating the take-up core, making it possible to reduce the consumption power of the printer.

A still further object of the present invention is to provide an ink ribbon cassette wherein the diameter of the take-up core is smaller than the diameter of the take-up core, whereby it is possible to cope with a so-called fattening in which the outer diameter of the ink ribbon taken up on the take-up core increases through damage during printing.

A still further object of the present invention is to provide an ink ribbon cassette wherein the supply core and the take-up core are supported so as to be rotatable between a pair of side walls formed in a direction perpendicular to the ribbon guide portion, whereby even when the supply core and the take-up core are long, it is possible to perform assembly while supporting the end portions of the supply core and the take-up core between the pair of side walls.

A still further object of the present invention is to provide an ink ribbon cassette wherein the main body portion is provided with a holder member which has the ribbon guide portion and holds the supply core and the take-up core, and a case member which can hold the holder member so as to cover from outside the supply core and the take-up core with a first case and a second case, wherein the holder member has a first side wall having a pair of circular bearing portions and a second side wall having a pair of semi-circular bearing portions, wherein the second case of the case member has a third side wall having a pair of semi-circular bearing portions, and wherein the other end portions of the supply core and the take-up core are rotatably supported by the semi-circular bearing portions of the second side wall and the third side wall, whereby even when the supply core and the take-up core are long, it is possible to mount the case member such that the supply core and the take-up core are covered with the end portions of the supply core and the take-up core being held, thereby achieving satisfactory assembly efficiency.

A still further object of the present invention is to provide an ink ribbon cassette wherein the case member is formed of a resin material and wherein the first case and the second case are joined by a thin-walled hinge, the first case and the second case being rotatable through this hinge portion, whereby the first case and the second case are formed as an integral u nit, thereby reducing the number of parts.

A still further object of the present invention is to provide an ink ribbon cassette wherein the case member has an engagement portion which can be engaged and disengaged by rotating the first case and/or the second case, and wherein the holder member held between the first case and the second case can be attached and detached inside the case member through engagement and disengagement of the engagement portion, whereby it is possible to easily replace the supply core and the take-up core around which the ink ribbon is wound, and the case member and the holder member can be re-utilized.

BRIEF DESCRIPTION OF THE DRAWINGS

FIGS. 4A through 4C are diagrams showing a holder member in the first embodiment of the present invention, of which FIG. 4A is a left-hand side view of the same;

FIG. 4B is a bottom view of the same; and

FIG. 4C is a right-hand side view of the same;

FIGS. 5A through 5C are diagrams showing a condition in which a first case and a second case of a case member of the first embodiment of the present invention are rotated by rotating a hinge portion, of which FIG. 5A is a left-hand side view of the same;

FIG. 5B is a bottom view of the same; and

FIG. 5C is a right-hand side view of the same;

FIGS. 7A through 7C are diagrams showing a holder member according to a second embodiment of the present invention, of which FIG. 7A is a left-hand side view of the same;

FIG. 7B is a bottom view of the same; and

FIG. 7C is a right-hand side view of the same;

FIGS. 8A through 8C are diagrams showing a condition in which a first case and a second case of a case member of the first embodiment of the present invention are rotated by rotating a hinge portion, of which FIG. 8A is a left-hand side view of the same;

FIG. 8B is a bottom view of the same; and

FIG. 8C is a right-hand side view of the same;

DESCRIPTION OF THE PREFERRED EMBODIMENTS

Figure 1:
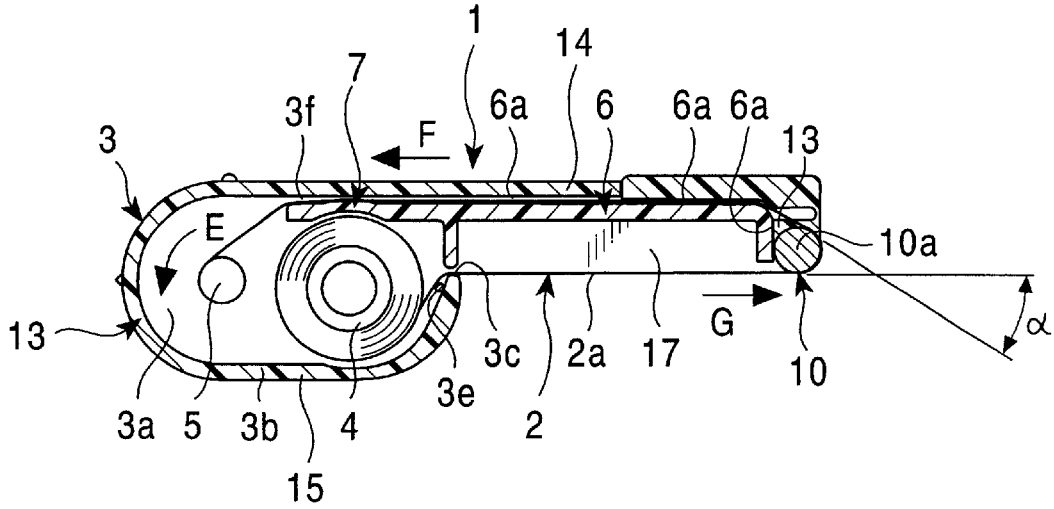
FIG. 1 is a sectional view of a main portion of a first embodiment of the present invention.
Figure 2:
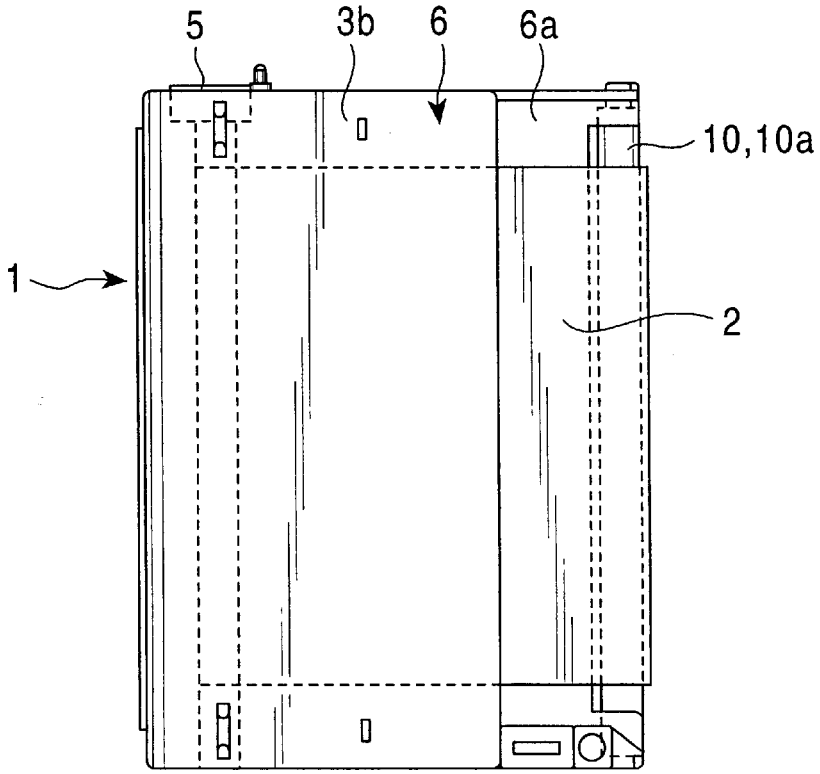
FIG. 2 is a top view of FIG. 1.
Figure 3:
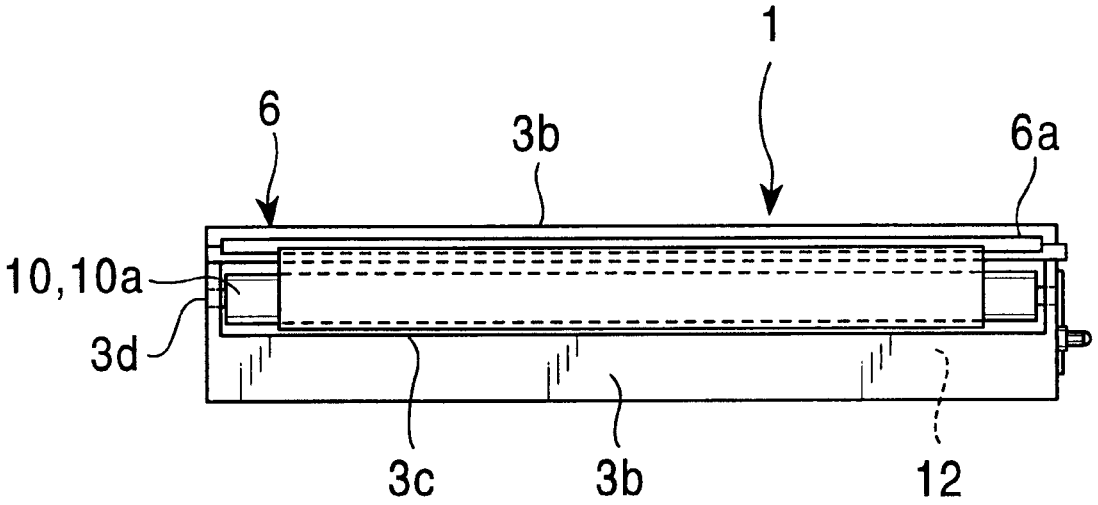
FIG. 3 is a left-hand side view of FIG. 1.

As shown in FIG. 1, the ink ribbon cassette 1 of the first embodiment of the present invention is provided with a main body portion 3 having a substantially elliptical hollow portion accommodating an ink ribbon 2 having on one side an ink surface 2*a*. This main body portion 3 accommodates a supply core 4 and a take-up core 5 around which the end portions of the ink ribbon 2 are wound.

The main body portion 3 has a pair of side walls 3*a* and upper and lower cases 3*b* to form a hollow interior. And, the supply core 4 and the take-up core 5 are rotatably held in the hollow portion of the main body portion 3.

Further, on the right-hand side of the supply core 4 in the main body portion 3, there is formed a slit-like ribbon outlet 3*c* through which the ink ribbon 2 wound around the supply core 4 can be drawn out to the exterior.

Further, the main body portion 3 has a ribbon guide portion 6 formed so as to extend to one side from this main body portion 3, and a holder member 7 which holds the supply core 4 and the take-up core 5 around which the ink ribbon 2 is wound.

Figure 4A:
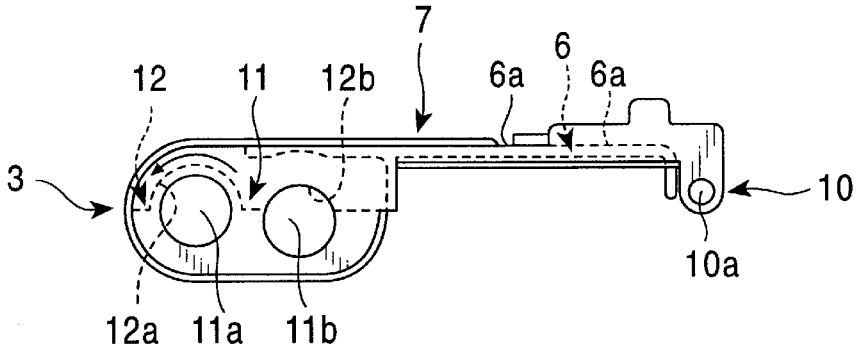
Figure 4B:
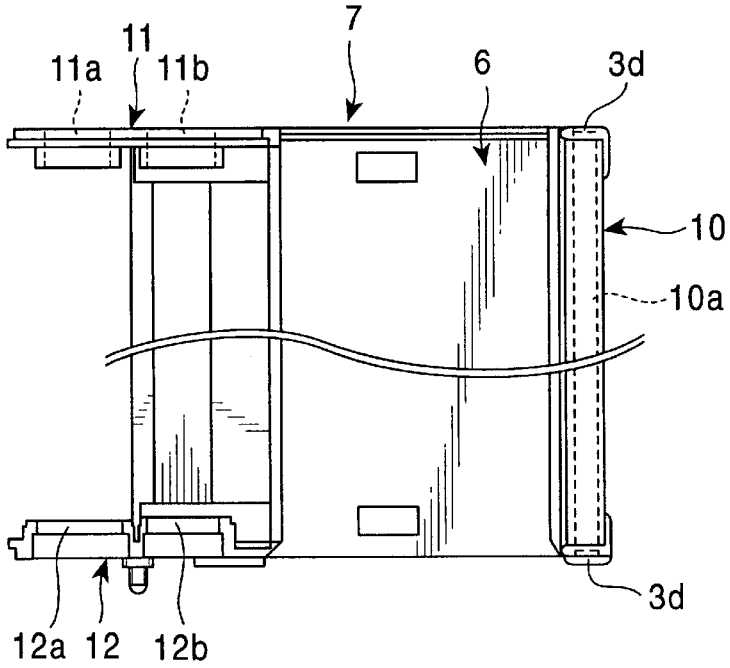

This holder member 7 is formed of a resin material. As shown in FIG. 4, in the portion constituting the main body portion 3, a first side wall 11 and a second side wall 12, which are a pair of side walls, are formed so as to be opposed to each other in a direction perpendicular to the direction in which the ribbon runs.

The first side wall 11 has a pair of circular bearing portions 11*a* and 11*b* and is formed in a substantially elliptical configuration, and the second side wall 12 has a pair of semi-circular bearing portions 12*a* and 12*b* and is formed in a configuration such as can be obtained by cutting the first side wall in half.

Further, the ribbon guide portion 6 formed so as to extend to one side from the main body portion 3 has on its upper side a ribbon slide contact surface 6*a* which can be brought into slide contact with the ribbon, and, at the right-hand end portion, there is formed a ribbon turn-up portion 10 having a rotatable turn-up roller 10*a*. The ink ribbon 2, drawn out through the ribbon outlet 3*c*, is turned up at the turn-up roller 10*a* at a turn-up angle $\alpha$, and drawn around to the ribbon slid contact surface 6*a*.

The turn-up angle $\alpha$ of the ink ribbon 2 is 10 to 80 degrees (The maximum angle is around 60 degrees), so that, when taking up the ink ribbon, it is possible to reduce the stress in the compressing direction applied to the ribbon guide portion 6, and the ribbon guide portion 6 is not deflected.

The turn-up roller 10*a* is formed as a cylinder and its end portions are rotatably supported by a pair of side walls 3*d* of the main body portion 3, so that the turn-up roller 10*a* rotates when taking up the ink ribbon 2 by the take-up core 5. Thus, it is possible to reduce the frictional resistance of the ink ribbon 2, which is drawn around the ribbon turn-up portion 10, and the ink ribbon 2 can be smoothly taken up on the take-up core 5.

Further, there is formed a gap 13 of a predetermined dimension between the ribbon turn-up portion 10 and the ribbon slide contact surface 6*a*, so that, between the ribbon turn-up portion 10 and the ribbon slide contact surface 6*a*, nothing comes into contact with the ink ribbon 2, thereby further reducing the frictional resistance when taking up the ink ribbon 2.

Further, at the portion of the ribbon outlet 3C which comes into contact with the ink ribbon, there is arranged a metal guide roller 3*e* which is rotatably held, whereby the draw-out load of the ink ribbon 2 drawn out from the main body portion 3 is reduced. Further, by forming the guide roller 3*e* of metal, the amount of static electricity generated in the ink ribbon can be reduced.

Further, the diameter of the take-up core 5 when no ink ribbon is wound around it is smaller than the diameter of the supply core 4 when no ink ribbon is wound around it. Due to this arrangement, if the ink ribbon 2 is thermally damaged during printing, it is possible to cope with a so-called fattening, in which the outer dimension of the take-up core 5 when the ink ribbon is taken up increases when the ink ribbon is taken up on the take-up core 5.

The supply core 4 and the take-up core 5 around which the ink ribbon 2 is wound can be supported by the holder member 7 by inserting one end portions into the circular bearing portions 11*a* and 11*b* of the first side wall 11 and positioning the other end portions in the semi-circular bearing portions 12*a* and 12*b* of the second side wall 12.

That is, in the ink ribbon cassette 1 of the present invention, the supply core 4 and the take-up core 5 are supported between the pair of first and second side walls 11 and 12 arranged in a direction perpendicular to the ribbon guide portion 6 (ribbon running direction).

Further, arranged in the main body portion 3 is a case member 13 capable of holding the holder member 7 by holding the supply core 4 and the take-up core 5 in such a way as to cover them from outside with first and second cases 14 and 15.

Figure 5A:
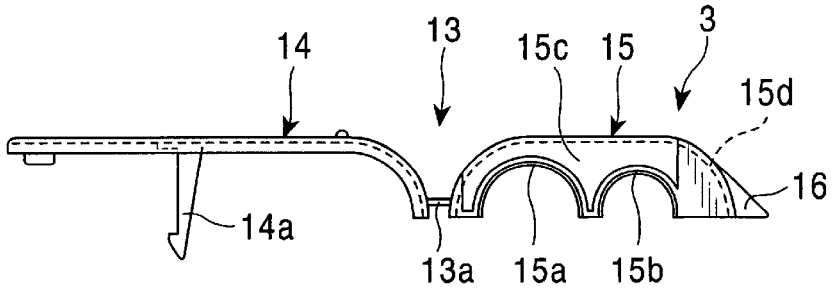

This case member 13 can be formed of a resin material. In FIG. 5, the first case 14 is arranged on the left-hand side, and the second case 15 is arranged on the right-hand side. The first case 14 and the second case 15 are joined by a thin-walled hinge portion 13*a*, and the first and second cases 14 and 15 are rotatable through the intermediation of this hinge portion 13*a*.

Further, provided in the first case 14 is an engagement claw 14*a* which is an engagement portion capable of engaging and disengaging the first case 14 and the second case 15 when the first case 14 and the second case 15 are rotated through the intermediation of the hinge portion 13*a*.

Figure 5B:
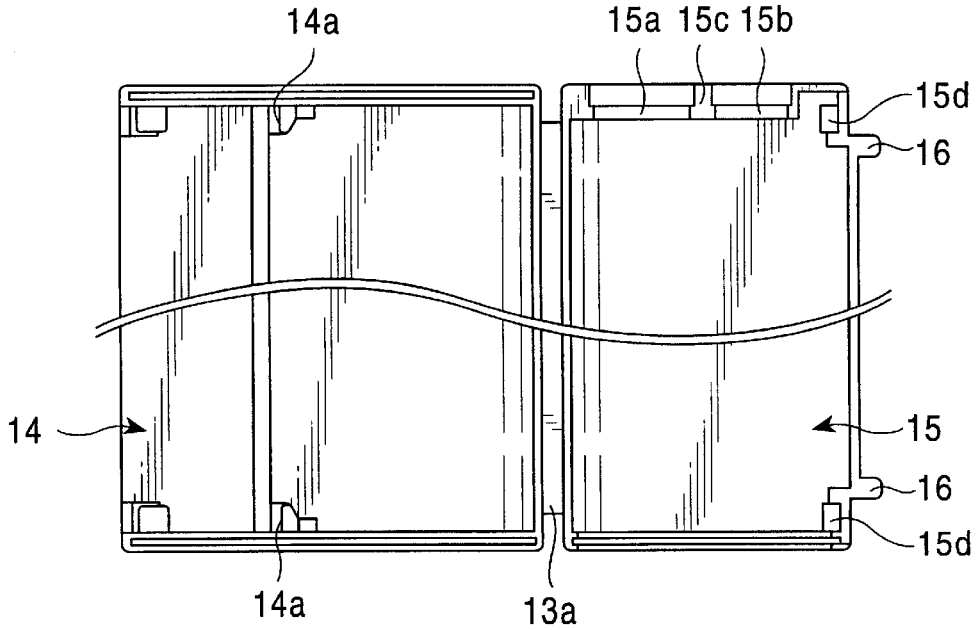
Figure 5C:
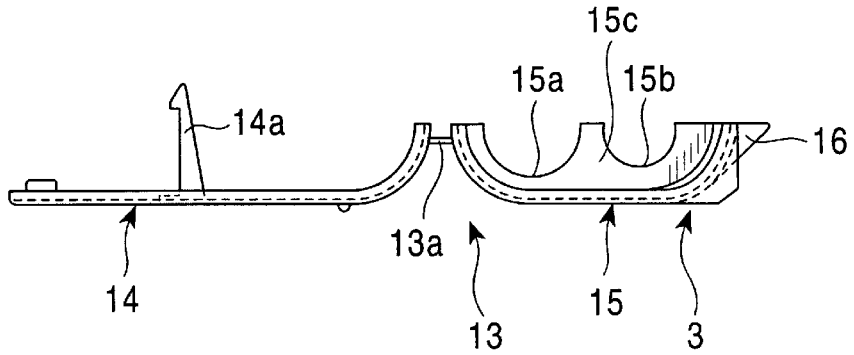

Further, at the upper end of the second case 15 shown in FIG. 5B, there is formed a third side wall 15*c* having a pair of semi-circular bearing portions 15*a* and 15*b*, and a pair of engagement holes 15*d* into which the engagement claw 14*a* of the first case 14 is inserted for snapping engagement extend therethrough. At the right-hand end of the second side wall 15, there are formed a pair of triangular paper guides 16.

That is, formed in the case member 13 are an engagement claw 14*a* and an engagement hole 15*d* which are engagement portions that can be engaged and disengaged through by rotating the first case 14 and/or the second case 15 through the intermediation of the hinge portion 13*a*.

Further, when the second case 15 of the case member 13 is positioned on the pair of first and second side walls 11 and 12 of the holder member 7, the second side wall 12 and the third side wall 13*c* abut each other so as to be opposed to each other, and the semi-circular bearing portions 12*a*, 15*a* and 12*b*, 15*b* are opposed to each other, forming a circular bearing portion.

Further, as shown in FIG. 1, when the supply core 4 and the take-up core 5 held by the holder member 7 are held in such a way as to cover them with the first case 14 and the second case 15, a slit-like ribbon outlet 3*c* through which the ink ribbon 2 wound around the supply core 4 can be drawn out.

Further, on the upper side of the ribbon guide portion 6, and between the ribbon slide contact surface 6*a* and the first case 14, there is formed a slit-like ribbon inlet 3*f*, and the ink ribbon 2 wound around the supply core 4 and drawn out from the ribbon outlet 3*c* can be drawn into the main body portion 3 again through the ribbon inlet 3*f* and taken up by the take-up core 5 from the condition in which it is turned up at the ribbon turn-up portion 10.

Figure 4C:
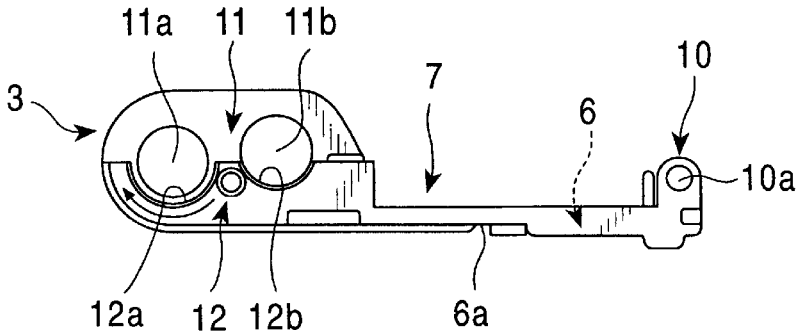

When assembling the ink ribbon cassette 1, constructed as described above, the holder member 7 is held in a position as shown in FIG. 4C in which the first side wall 11 and the second side wall 12 are directed upward, and one end portion of the supply core 4 is inserted into the circular bearing portion 11*b* of the first side wall 11, and the other end portion of the supply core 4 is positioned in the semi-circular bearing portion 12*b* of the second side wall 12.

In this condition, the take-up core 5 around which the ink ribbon 2 is wound is passed over the ribbon guide portion 6 shown in FIG. 4C and moved to the ribbon turn-up portion 10 side, and the lower portion of the ribbon guide portion 6 is turned to the left from the ribbon turn-up portion 10.

Then, the ink ribbon 2 is drawn out from the supply core 4, and turned up downwardly at the ribbon turn-up portion 10 and guided on the ribbon slide contact surface 6*a* of the ribbon guide portion 6. In this condition, the take-up core 5 is moved to the first side wall 11 and the second side wall 12, and one end portion of the take-up core 5 is inserted into the circular bearing portion 11*a* of the first side wall 11, and the other end portion of the take-up core 5 is positioned in the semi-circular bearing portion 12*a* of the second side wall 12.

Then, one end portions of the supply core 4 and the take-up core 5 are supported by the circular bearing portions 11*a* and 11*b,* and the lower halves of the other end portions thereof are supported by the semi-circular bearing portions 12*a* and 12*b,* and the ink ribbon 2 is drawn over the ribbon slide contact surface 6*a* from the supply core 4 by way of the ribbon turn-up portion 10, and can be taken up by the take-up core 5.

Figure 6:
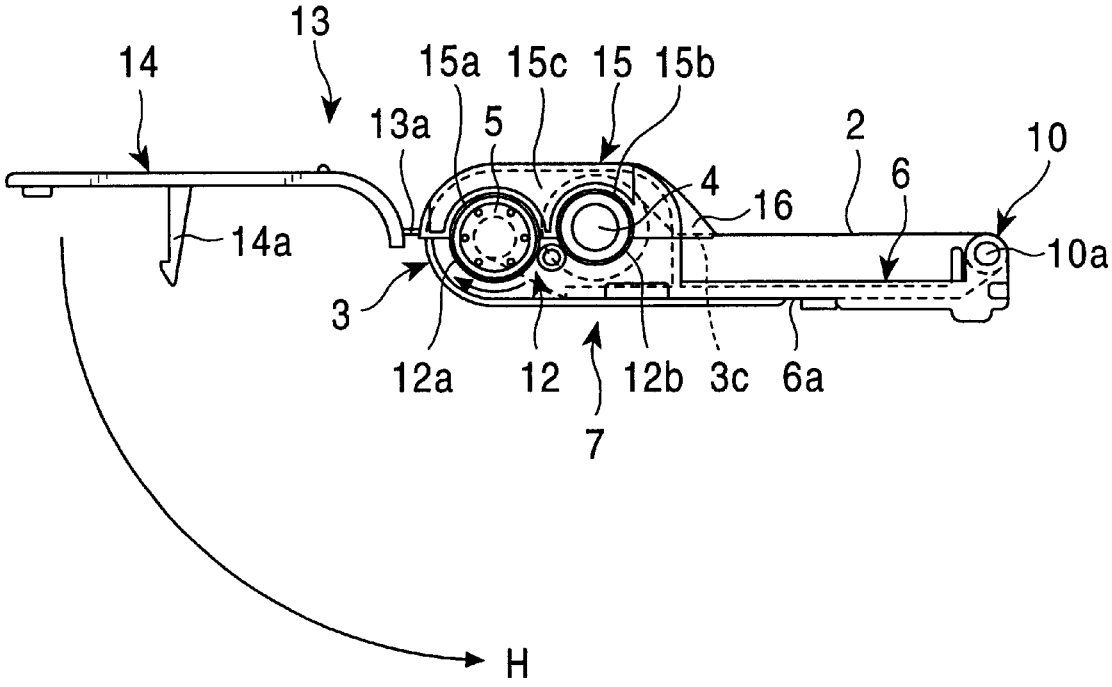
FIG. 6 is a diagram illustrating the assembly of a case member and a holder member according to the first embodiment of the present invention.

Next, when, as shown in FIG. 6, the second case 15 of the case member 13 is placed in such a way as to cover the upper portions of the supply core 4 and the take-up core 5 the end portions of which are held by the bearing portions 11*a,* 11*b,* 12*a* and 12*b* of the holder member 7, the semi-circular bearing portions 15*a* and 15*b* of the third side wall 15*c* are placed over the supply core 4 and the take-up core 5 the upper halves of which are exposed through the semi-circular bearing portions 12*a* and 12*b* of the second side wall 12, and the entire outer peripheral portion of the other end portions of the supply core 4 and the take-up core 5 are held by the bearing portions 12*a,* 12*b,* 15*a* and 15*b*.

When, in this condition, the first case 14 shown in FIG. 4 is rotated in the direction of the arrow H, the engagement claw 14 which is an engagement portion is snap-engaged with the engagement hole 15*d* which is the engagement portion of the second case 15, and the supply core 4 and the take-up core 5 are held in such a way as to be covered from outside with the first and second cases 14 and 15, whereby the ink ribbon cassette 1 as shown in FIG. 1 is assembled.

Between the ink ribbon 2 drawn out from the ribbon outlet 3*c* and the ribbon guide portion 6, there is formed a head insertion portion 17 into which a line thermal head (not shown) supported in a cantilever-like fashion on the printer (not shown) side can be inserted.

The ink ribbon 2 of the ink ribbon cassette 1 of the present invention, described above, is temporarily drawn out to the exterior through the ribbon outlet 3*c* formed in the main body portion 3 through the rotation of the core 5 in the direction of the arrow E, and drawn around below the head insertion portion 17 in the direction of the arrow G. And, from the condition in which it is turned up at a turn-up angle of $\alpha$ at the turn-up roller 8 which is the ribbon turn-up portion 7, the ribbon runs on the ribbon slide contact surface 6*a* of the ribbon guide portion 6, and is drawn into the main body portion 3 again through the ribbon inlet 3*f,* and can be taken up by the take-up core 5.

Further, in the case member 13, by rotating the first case 14 and/or the second case 15, the engagement portion consisting of the engagement claw 14*a* and the engagement hole 13*d* can be engaged and disengaged, and the holder member 7 held between the first and second cases 14 and 15 is detachable with respect to the case member 13 through engagement and disengagement of the engagement portion.

The printing operation by a thermal transfer printer using the ink ribbon cassette 1 of the first embodiment of the present invention, described above, will be illustrated. First, the ink ribbon 1 is attached to a cassette attachment portion (not shown) on the printer side.

Then, the line thermal head (not shown) on the printer side is inserted into the head insertion portion 17 and positioned therein.

At this time, below the line thermal head, a rotatable platen roller (not shown) arranged on the printer side is positioned.

And, the ink ribbon 2 is positioned between the line thermal head and the platen roller, and, below this ink ribbon 2, recording paper (not shown) that has been fed is positioned.

Next, the platen roller is moved upwardly or the line thermal head is moved downwardly to thereby bring the line thermal head and the platen roller into press contact with each other through the intermediation of the recording paper and the ink ribbon 2, and a plurality of heat generating elements (not shown) formed in the line thermal head are selectively caused to generate heat on the basis of printing information.

And, while feeding the recording paper, the take-up core 5 is rotated in the direction of the arrow 5 to take up the ribbon 2 in the direction of the arrow F. Then, the turn-up roller 10*a* of the turn-up portion 10 rotates, and the recording paper and the ink ribbon 2 held between the line thermal head and the platen roller are fed to the downstream side in the direction of the arrow G.

Then, the ink of the ink ribbon 2 is transferred to the recording paper, whereby a desired image is printed on the recording paper.

After the printing, the ink ribbon 2, the ink of which has been transferred to the recording paper, runs on the ribbon slide contact surface 6*a* of the ribbon guide portion 6 from the condition in which it is turned up at the rotatable turn-up roller 10*a,* and is drawn into the main body portion 3 again and can be taken up by the take-up core 5.

Thus, the ink ribbon 2 can be taken up by the low-torque take-up core 5, and no excessive tensile force is applied to the ink ribbon 2 when it is taken up, so that the ribbon guide portion 6 is not deflected, and there is no biasing of the ink ribbon 2 and no wrinkles or the like are generated therein.

While in the first embodiment of the present invention described above the ribbon is turned up at the ribbon turn-up portion 10, with the ink ribbon 2 being turned up at a turn-up angle of 60 degrees, it is possible to take up the ink ribbon 2 turned up at the ribbon turn-up portion 10 with a low torque as long as the turn-up angle is in the range of 10 to 80 degrees.

Figure 9:
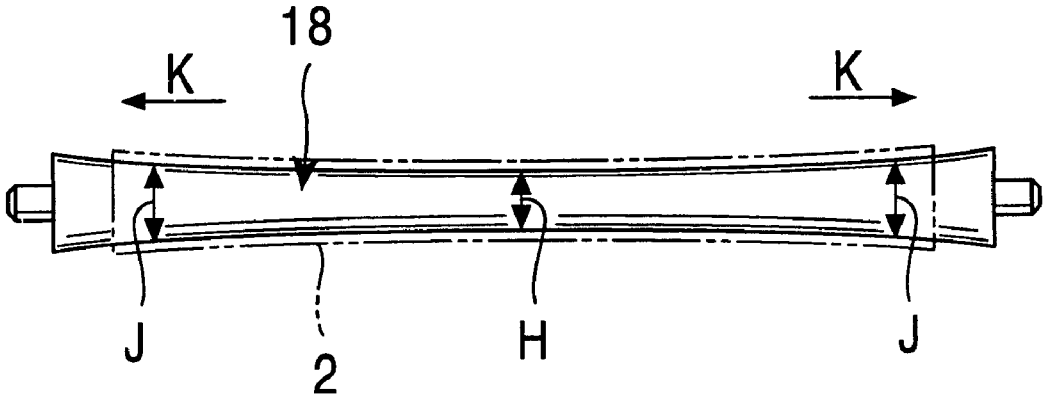
FIG. 9 is a diagram showing a turn-up roller according to an embodiment of the present invention.
Figure 10:
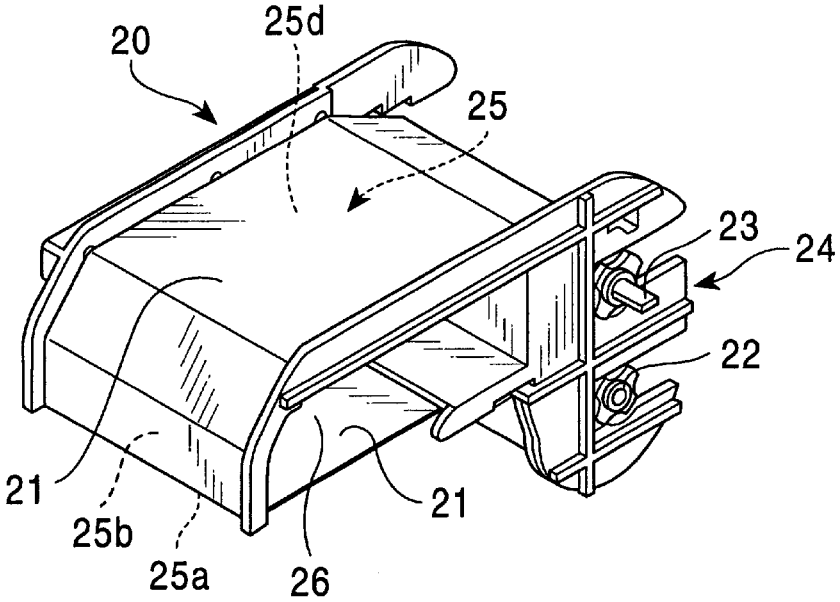
FIG. 10 PRIOR ART
FIG. 10 is a perspective view of a conventional ink ribbon.
Figure 11:
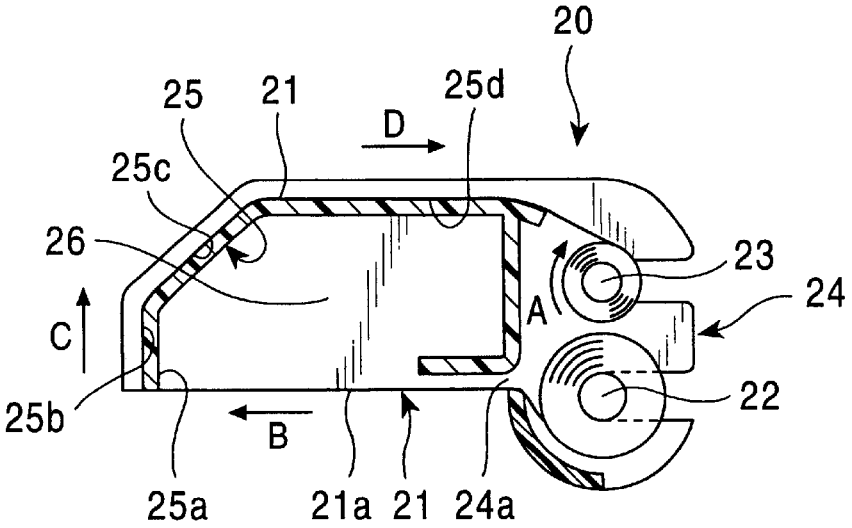
FIG. 11 PRIOR ART
FIG. 11 is a sectional view of a main portion of the conventional ink ribbon.

While in the first embodiment of the present invention described above the turn-up roller 10*a* is formed as a cylinder, it is also possible, as shown in FIG. 9, for the turn-up roller 10*a* to be formed in a hand-drum-like configuration in which the outer diameter J of the portions where the end portions with respect to the width direction of the ink ribbon 2 are positioned is larger than the outer diameter H of the portion where the portion of the ink ribbon 2 near its center is positioned. In this turn-up roller 10*a,* the outer diameter J of the end portions is larger than the outer diameter H of the portion near the center by approximately 0.1 mm.

When the ink ribbon 2 is taken up on the take-up core 5 by using this hand-drum-like turn-up roller 10*a,* the end portions of the ink ribbon 2 with respect to its width direction positioned on the portions having the outer diameter J are pulled outwardly in the directions of the arrows K.

Thus, outward tensile forces in the directions of the arrows K are applied to the ink ribbon 2, and no wrinkles are generated in the ink ribbon 2 being taken up, whereby it is possible to achieve an improvement in printing quality.

Figure 7A:
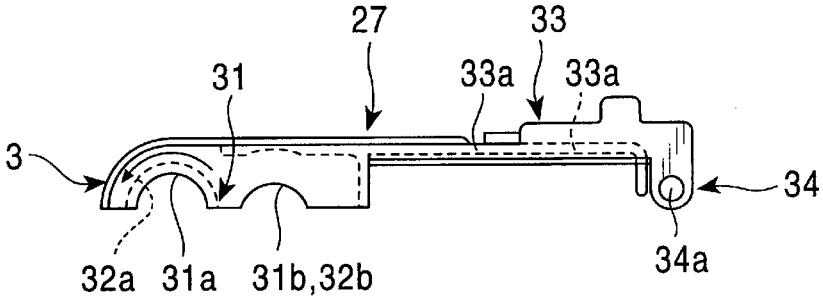
Figure 7B:
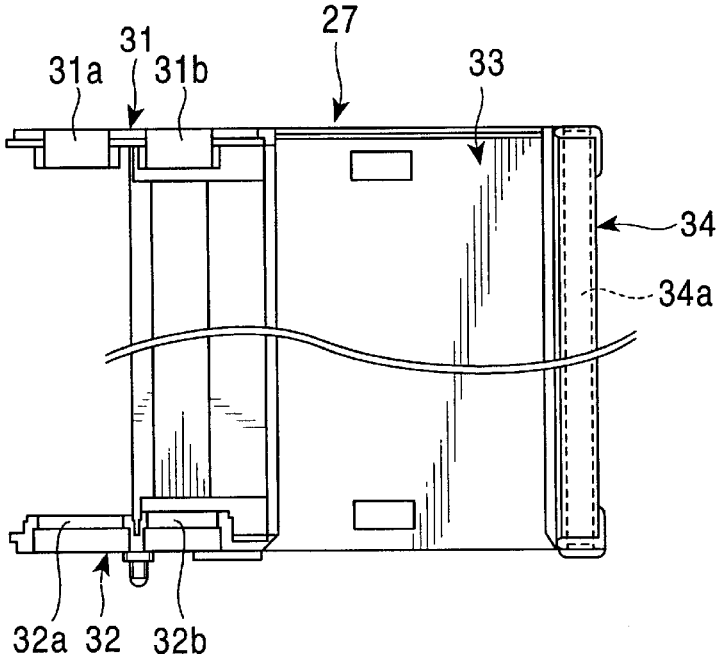
Figure 7C:
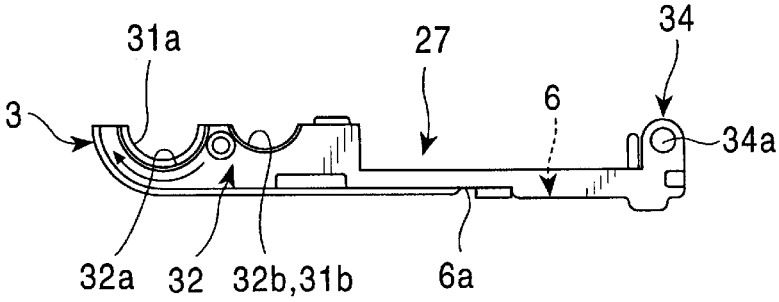

A second embodiment of the present invention will be described with reference to FIGS. 7 and 8. First, as shown in FIG. 7, in the holder member 27 constituting a part of the main body portion 3, there are formed a first side wall 31 having a pair of semi-circular bearing portions 31*a* and 31*b,* and a second side wall 32 having a pair of semi-circular bearing portions 32*a* and 32*b,* and in the ribbon guide portion 33, there are formed a ribbon slide contact surface 33*a* and a ribbon turn-up portion 34 having a turn-up roller 34*a.*

Figure 8A:
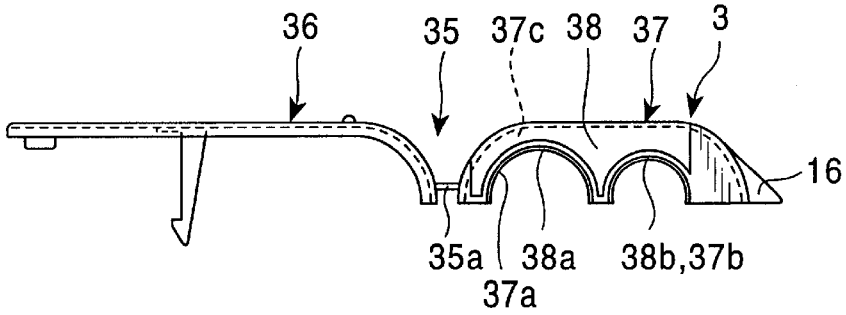
Figure 8B:
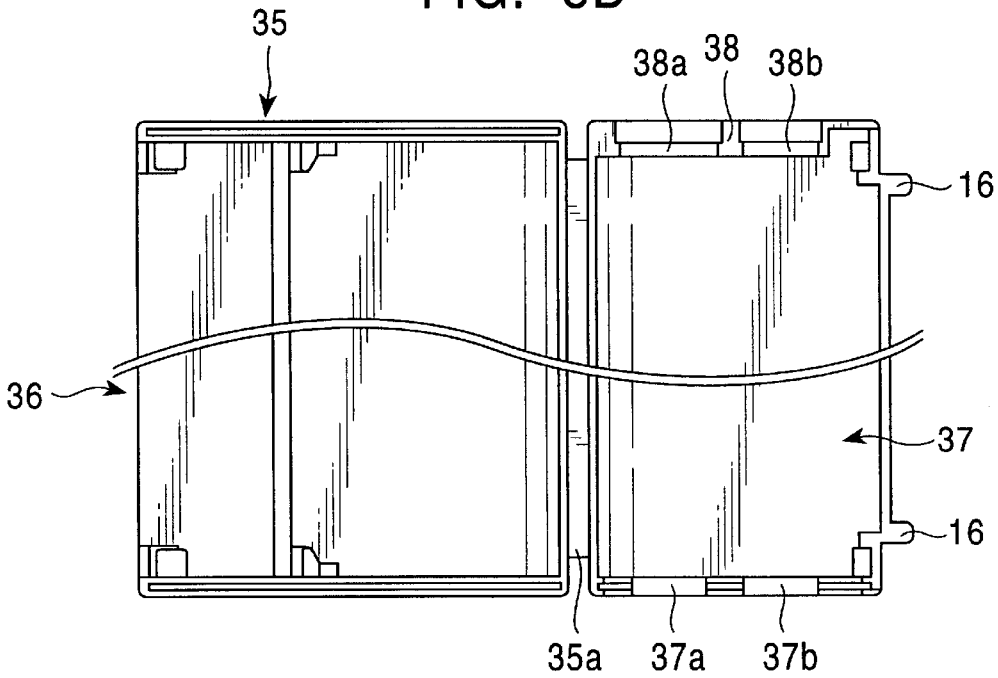
Figure 8C:
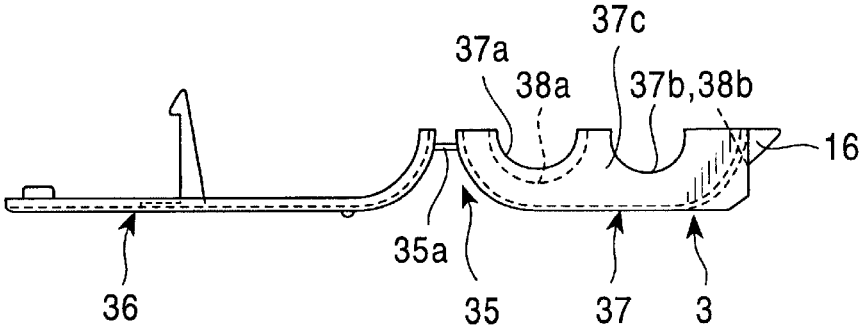

Further, as shown in FIG. 8, in a case member 35 constituting a part of the main body portion 3, a first case 36 and a second case 37 are joined by a thin-walled hinge portion 35*a* to form an integral unit. In the second case 37, there is formed, in the portion opposite to the first side wall 31 of the holder member 27, a third side wall 37*c* having a pair of semi-circular bearing portions 37*a* and 37*b,* and, in the portion opposite to the second side wall 32 of the holder member 27, there is formed a fourth side wall 38 having a pair of semi-circular bearing portions 38*a* and 38*b.* That is, the bearing portions of the side walls 31, 32, 37 and 38 are all formed in a semi-circular configuration.

In this second embodiment, one end portions of the supply core 4 and the take-up core 5 are supported by the bearing portions 31*a,* 31*b,* 37*a* and 37*b* of the first side wall 31 and the third side wall 37*c,* and the other end portions of the supply core 4 and the take-up core 5 are supported by the bearing portions 32*a,* 32*b,* 38*a* and 38*b* of the second side wall 32 and the fourth side wall 38.

In this second embodiment of the present invention, the supply core 4 and the take-up core 5 are held in such a way as to be covered with the first and second cases 36 and 37, with the supply core 4 and the take-up core 5 being placed in the semi-circular bearing portions 31*a,* 31*b,* 32*a* and 32*b* of the holder member 27, so that there is no need to perform the operation of inserting one end portions of the supply core 4 and the take-up core 5 into the circular bearing portions 8*a* and 8*b* as in the first embodiment, whereby a further improvement is achieved in terms of assembly performance as compared with the first embodiment.

As described above, the ink ribbon of the ink ribbon cassette of the present invention is temporarily drawn out to the exterior from the ribbon outlet formed in the main body portion, and, from the condition in which it is turned up at the ribbon turn-up portion, it runs on the ribbon slide contact surface of the ribbon guide portion, and is again drawn into the main body portion to be taken up by the take-up core, so that the ink ribbon is accommodated in the case of the main body portion, whereby there is no fear of the ink ribbon being inadvertently touched during the handling of the ink ribbon cassette. Thus, it is possible to provide an ink ribbon cassette in which no wrinkles are generated in the ink ribbon during handling.

Further, since the turn-up angle of the ink ribbon turned up at the ribbon turn-up portion is 10 to 80 degrees, it is possible to reduce the frictional resistance at the ribbon turn-up portion when taking up the ink ribbon through distribution.

Thus, when taking up the ribbon, the ribbon guide portion is not deflected, whereby it is possible to prevent biasing of the ink ribbon or the like.

Further, the ribbon turn-up portion has a rotatable turn-up roller, and the ink ribbon is turned up by this turn-up roller, so that it is possible to reduce the frictional resistance of the ink ribbon when it is turn up at the ribbon turn-up portion.

Thus, it is possible to reduce the capacitance of the motor for rotating the take-up core, making it possible to provide an ink ribbon cassette capable of reducing the power consumption of the printer.

Further, the turn-up roller is formed in a hand-drum-like configuration in which the outer diameter of the portions where the end portions with respect to the width direction of the ink ribbon are positioned is larger than the outer diameter of the portion where the portion of the ink ribbon near the center is positioned, so that an outward tensile force is applied to the end portions with respect to the width direction of the ink ribbon turned up at the turn-up roller, and wrinkles or the like are not generated in the ink ribbon. Thus, it is possible to achieve an improvement in printing quality.

Further, the ink ribbon cassette of the present invention is provided with a main body portion accommodating the supply core and the take-up core, and a ribbon guide portion extending to one side from this main body portion, and the supply core and the take-up core are rotatably supported between a pair of side walls formed in a direction perpendicular to the ribbon guide portion, so that even if the supply core and the take-up core are long, it is possible to perform assembly while supporting the end portions of the supply core and the take-up core between the pair of walls, whereby it is possible to provide an ink ribbon cassette providing satisfactory assembly performance.

Further, one end portions of the supply core and the take-up core are supported by circular bearing portions of the first side wall, and the other end portions of the supply core and the take-up core are supported by semi-circular bearing portions of the second and third side walls, so that, even if the supply core and the take-up core are long, it is possible to mount the case member so as to cover the supply core and the take-up core, with the end portions of the supply core and take-up core being supported by the bearing portions of the first and second side walls of the holder member, whereby it is possible to provide an ink ribbon cassette having satisfactory assembly efficiency.

Further, by making the bearing portion of the first side wall circular, it is possible to form the bearing portion with high accuracy, and one end portions of the supply core and the take-up core can be supported by the circular bearing portion without any play, making it possible to take up the ink ribbon without involving any biasing or the like.

Further, one end portions of the supply core and the take-up core are supported by the semi-circular bearing portions of the first and third side walls, and the other end portions of the supply core and the take-up core are supported by the semi-circular bearing portions of the second and fourth side walls, so that the supply core and the take-up core can be temporarily held by the holder member solely by placing the end portions of the supply core and the take-up core from above on the semi-circular bearing portions of the first and second side walls of the holder member, making it possible to provide an ink ribbon cassette which can be easily assembled.

Further, the case member is formed of a resin material, and the first and second cases are joined by a thin-walled hinge portion, the first and second cases being rotatable through this hinge portion, so that the first and second cases are combined by the hinge portion to form the case member as an integral unit, thereby reducing the number of parts.

Further, the case member has an engagement portion which can be engaged and disengaged by rotating the first case and/or the second case, and the holder member held between the first and second cases can be attached and detached through engagement and disengagement of the engagement portion, so that it is possible to attach and detach the holder member to and from the case member, and the supply core and the take-up core around which the ink ribbon, which is expendable, is wound, can be easily replaced, the case member and the holder member being capable of re-utilized. Thus, it is possible to provide an ink ribbon cassette which is friendly to the environment.

What is claimed is:

1. An ink ribbon cassette comprising:

a main body portion accommodating an ink ribbon;

a supply core and a take-up core which are accommodated in the main body portion so as to be adjacent to each other and around which the end portions of the ink ribbon are wound;

a ribbon guide portion extending to one side from the main body portion and having on one side a ribbon slide contact surface; and a ribbon turn-up portion formed at the forward end of the ribbon guide portion, wherein the ink ribbon is temporarily drawn out to the exterior from a ribbon outlet formed in the main body portion, runs on the ribbon slide contact surface of the ribbon guide portion from the condition in which it is turned up at the ribbon turn-up portion, and is drawn into the main body portion through an ink ribbon inlet formed in the main body portion to be taken up by the take-up core, and wherein the ribbon turn-up portion is formed by a rotatable roller member.

2. An ink ribbon cassette according to claim 1, wherein the roller member has a hand-drum-like configuration in which the outer dimension of the portion thereof near the central portion is smaller than the outer dimension of the end portions thereof.

3. An ink ribbon cassette according to claim 1, wherein there is formed between the ink ribbon drawn out between the ribbon outlet and the turn-up portion and the ribbon guide portion a gap into which a thermal head of the printer is to be inserted when the ink ribbon cassette is attached to the printer.

4. An ink ribbon cassette according to claim 1, wherein the diameter of the take-up core is smaller than the diameter of the supply core.

5. An ink ribbon cassette according to claim 1, wherein the supply core and the take-up core are rotatably supported between a pair of side walls formed in a direction perpendicular to the ribbon guide portion.

6. An ink ribbon cassette comprising:

a main body portion accommodating an ink ribbon;

a supply core and a take-up core which are accommodated in the main body portion so as to be adjacent to each other and around which the end portions of the ink ribbon are wound;

a ribbon guide portion extending to one side from the main body portion and having on one side a ribbon slide contact surface; and a ribbon turn-up portion formed at the forward end of the ribbon guide portion, wherein the ink ribbon is temporarily drawn out to the exterior from a ribbon outlet formed in the main body portion, runs on the ribbon slide contact surface of the ribbon guide portion from the condition in which it is turned up at the ribbon turn-up portion, and is drawn into the main body portion through an ink ribbon inlet formed in the main body portion to be taken up by the take-up core, and wherein the turn-up angle of the ink ribbon turned up at the ribbon turn-up portion is 10 to 80 degrees.

7. An ink ribbon cassette according to claim 6, wherein the turn-up angle of the ink ribbon is 60 degrees.

8. An ink ribbon cassette comprising:

a main body portion accommodating an ink ribbon;

a supply core and a take-up core which are accommodated in the main body portion so as to be adjacent to each other and around which the end portions of the ink ribbon are wound;

a ribbon guide portion extending to one side from the main body portion and having on one side a ribbon slide contact surface; and a ribbon turn-up portion formed at the forward end of the ribbon guide portion, wherein the ink ribbon is temporarily drawn out to the exterior from a ribbon outlet formed in the main body portion, runs on the ribbon slide contact surface of the ribbon guide portion from the condition in which it is turned up at the ribbon turn-up portion, and is drawn into the main body portion through an ink ribbon inlet formed in the main body portion to be taken up by the take-up core, and wherein a rotatable guide roller is arranged in the portion of the ribbon outlet with which the ink ribbon comes into contact.

9. An ink ribbon cassette according to claim 8, wherein the guide roller is formed of metal.

10. An ink ribbon cassette comprising:

a main body portion accommodating an ink ribbon;

a supply core and a take-up core which are accommodated in the main body portion so as to be adjacent to each other and around which the end portions of the ink ribbon are wound;

a ribbon guide portion extending to one side from the main body portion and having on one side a ribbon slide contact surface; and a ribbon turn-up portion formed at the forward end of the ribbon guide portion, wherein the ink ribbon is temporarily drawn out to the exterior from a ribbon outlet formed in the main body portion, runs on the ribbon slide contact surface of the ribbon guide portion from the condition in which it is turned up at the ribbon turn-up portion, and is drawn into the main body portion through an ink ribbon inlet formed in the main body portion to be taken up by the take-up core, and wherein the main body portion comprises:

a holder member having the ribbon guide portion and holding the supply core and the take-up core; and a case member capable of holding the holder member by holding a first case and a second case in such a way as to cover from outside the supply core and the take-up core, wherein formed on the holder member are a first side wall having a pair of circular bearing portions and a second side wall having a pair of semi-circular bearing portions, wherein the second case of the case member has in the portion thereof opposed to the second side wall a third side wall having a pair of semi-circular bearing portions, wherein one end portions of the supply core and the take-up core are rotatably supported by the circular bearing portions of the first side wall of the holder member, and wherein the other end portions of the supply core and the take-up core are rotatably supported by the semi-circular bearing portions of the second side wall of the holder member and the third side wall of the second case.

11. An ink ribbon cassette according to claim 10, wherein the case member is formed of a resin material and the first case and the second case are joined by a thin-walled hinge, the first case and the second case being rotatable through this hinge portion.

12. An ink ribbon cassette according to claim 11, wherein the case member has an engagement portion which can be engaged and disengaged by rotating the first case and/or the second case, and wherein the holder member held between the first case and the second case can be attached and detached in the case member by performing engagement and disengagement of the engagement portion.

13. An ink ribbon cassette comprising:

a main body portion accommodating an ink ribbon;

a supply core and a take-up core which are accommodated in the main body portion so as to be adjacent to each other and around which the end portions of the ink ribbon are wound;

a ribbon guide portion extending to one side from the main body portion and having on one side a ribbon slide contact surface; and a ribbon turn-up portion formed at the forward end of the ribbon guide portion, wherein the ink ribbon is temporarily drawn out to the exterior from a ribbon outlet formed in the main body portion, runs on the ribbon slide contact surface of the ribbon guide portion from the condition in which it is turned up at the ribbon turn-up portion, and is drawn into the main body portion through an ink ribbon inlet formed in the main body portion to be taken up by the take-up core, and wherein the main body portion comprises:

a holder member having the ribbon guide portion and holding the supply core and the take-up core; and a case member capable of holding the holder member by holding a first case and a second case in such a way as to cover from outside the supply core and the take-up core, wherein formed on the holder member are a first side wall having a pair of circular bearing portions and a second side wall having a pair of semi-circular bearing portions, wherein the second case of the case member has in the portion thereof opposed to the second side wall a third side wall having a pair of semi-circular bearing portions, and has in the portion opposed to the second side wall a fourth side wall having a pair of semi-circular bearing portions, wherein one end portions of the supply core and the take-up core are rotatably supported by the bearing portions of the first side wall and the third side wall, and wherein the other end portions of the supply core and the take-up core are rotatably supported by the bearing portions of the second side wall and the fourth side wall.

14. An ink ribbon cassette according to claim 13, wherein the case member is formed of a resin material and the first case and the second case are joined by a thin-walled hinge, the first case and the second case being rotatable through this hinge portion.

15. An ink ribbon cassette according to claim 14, wherein the case member has an engagement portion which can be engaged and disengaged by rotating the first case and/or the second case, and wherein the holder member held between the first case and the second case can be attached and detached in the case member by performing engagement and disengagement of the engagement portion.

* * * * *